US011896875B1

(12) United States Patent
Hendricks et al.

(10) Patent No.: US 11,896,875 B1
(45) Date of Patent: Feb. 13, 2024

(54) DYNAMIC MOTION FORCE SENSOR MODULE

(71) Applicant: Dynamic Accession LLC, Iselin, NJ (US)

(72) Inventors: Shawn A. Hendricks, Fords, NJ (US); Christopher M. Toner, Germantown, MD (US)

(73) Assignee: Dynamic Accession, LLC, Iselin, NJ (US)

( * ) Notice: Subject to any disclaimer, the term of this patent is extended or adjusted under 35 U.S.C. 154(b) by 0 days.

(21) Appl. No.: 18/139,159

(22) Filed: Apr. 25, 2023

Related U.S. Application Data

(62) Division of application No. 18/077,464, filed on Dec. 8, 2022.

(51) Int. Cl.

| | |
|---|---|
| ***A63B 24/00*** | (2006.01) |
| ***A63B 21/00*** | (2006.01) |
| ***A63B 21/005*** | (2006.01) |
| ***A63B 71/06*** | (2006.01) |
| ***A63B 71/00*** | (2006.01) |

(52) U.S. Cl.
CPC ..... *A63B 24/0087* (2013.01); *A63B 21/0058* (2013.01); *A63B 21/153* (2013.01); *A63B 24/0062* (2013.01); *A63B 71/0054* (2013.01); *A63B 71/0622* (2013.01); *A63B 2024/0093* (2013.01); *A63B 2071/0072* (2013.01); *A63B 2071/0625* (2013.01); *A63B 2220/51* (2013.01); *A63B 2220/833* (2013.01); *A63B 2225/50* (2013.01)

(58) Field of Classification Search
None
See application file for complete search history.

(56) References Cited

U.S. PATENT DOCUMENTS

| | | | | |
|---|---|---|---|---|
| 5,645,124 | A | 7/1997 | Hartfield | |
| 5,993,356 | A | 11/1999 | Houston et al. | |
| 6,280,361 | B1 * | 8/2001 | Harvey | A63B 24/00 482/4 |
| 9,586,089 | B2 | 3/2017 | Anthony et al. | |

(Continued)

FOREIGN PATENT DOCUMENTS

| | | | |
|---|---|---|---|
| CA | 298911 | A1 | 3/2021 |
| WO | 1991011221 | A1 | 8/1991 |

(Continued)

OTHER PUBLICATIONS

PCT Search Report, dated Jul. 16, 2021, International Bureau of WIPO.

(Continued)

*Primary Examiner* — Joshua Lee
(74) *Attorney, Agent, or Firm* — Danielle C. Sullivan; Carter Ledyard & Milburn LLP

(57) ABSTRACT

A torque measurement system and method for providing real time tracking and motor control for adjusting standard and dynamic torque-to-linear forces in an electromechanical motor. The system includes sensors for measuring data, load wedges affixed to a rotor, a slip bearing for measuring forward and reverse forces of the rotor section, a tracking measurement unit adapted to measure raw data, a wireless radio, an internal processor, and a tracking processing unit.

12 Claims, 13 Drawing Sheets

(56) References Cited

U.S. PATENT DOCUMENTS

| | | | | |
|---|---|---|---|---|
| 9,962,576 | B2 | 5/2018 | Anderson | |
| 10,143,880 | B1 * | 12/2018 | Boatwright | A63B 21/078 |
| 10,220,261 | B1 * | 3/2019 | Garsdean | A63B 24/0087 |
| 10,486,015 | B2 | 11/2019 | Orady | |
| 10,589,163 | B2 | 3/2020 | Orady | |
| 10,617,903 | B2 | 4/2020 | Orady | |
| 1,066,111 | A1 | 5/2020 | Orady | |
| 10,765,914 | B1 * | 9/2020 | Trexler | A63B 21/00069 |
| 11,040,231 | B2 * | 6/2021 | Rubin | A63B 71/0622 |
| 2005/0107719 | A1 | 5/2005 | Abbound | |
| 2006/0136173 | A1 | 6/2006 | Case et al. | |
| 2007/0155587 | A1 * | 7/2007 | Huang | A63B 23/12 482/148 |
| 2008/0119763 | A1 | 5/2008 | Weiner | |
| 2008/0248926 | A1 | 10/2008 | Cole et al. | |
| 2008/0262392 | A1 | 10/2008 | Ananny et al. | |
| 2009/0269728 | A1 | 10/2009 | Verstegen et al. | |
| 2010/0234184 | A1 | 9/2010 | Le Page et al. | |
| 2013/0065680 | A1 | 3/2013 | Zavdsky et al. | |
| 2014/0038777 | A1 * | 2/2014 | Bird | A63B 23/03525 482/5 |
| 2014/0135593 | A1 | 5/2014 | Jayalth et al. | |
| 2014/0194250 | A1 * | 7/2014 | Reich | A63B 24/0084 482/5 |
| 2014/0287876 | A1 | 9/2014 | Eitter et al. | |
| 2015/0120016 | A1 | 4/2015 | Houfmanfar et al. | |
| 2015/0287768 | A1 | 10/2015 | Luna et al. | |
| 2015/0309563 | A1 | 10/2015 | Connor et al. | |
| 2015/0366504 | A1 | 12/2015 | Connor et al. | |
| 2018/0001181 | A1 | 1/2018 | Von Prellwitz et al. | |
| 2018/0021614 | A1 | 1/2018 | Taft et al. | |
| 2018/0021616 | A1 | 1/2018 | Orady et al. | |
| 2018/0100751 | A1 | 4/2018 | Toner | |
| 2018/0214729 | A1 * | 8/2018 | Rubin | A63B 24/0087 |
| 2018/0361189 | A1 * | 12/2018 | Gupta | A63B 21/0054 |
| 2019/0099119 | A1 | 4/2019 | Wakeham et al. | |
| 2019/0151716 | A1 | 5/2019 | Bird | |
| 2020/0047027 | A1 * | 2/2020 | Ward | G06F 3/0346 |
| 2020/0047031 | A1 * | 2/2020 | Orady | A63B 24/0062 |
| 2020/0070032 | A1 | 3/2020 | Orady | |
| 2020/0151595 | A1 | 5/2020 | Jayatlh et al. | |
| 2020/0164246 | A1 * | 5/2020 | Snover | A63B 21/00061 |
| 2020/0289890 | A1 | 9/2020 | Kim et al. | |
| 2021/0008402 | A1 | 1/2021 | Orady | |
| 2021/0038937 | A1 | 2/2021 | Orady | |
| 2021/0038938 | A1 | 2/2021 | Orady | |

FOREIGN PATENT DOCUMENTS

| | | | |
|---|---|---|---|
| WO | 2017106781 | A1 | 6/2017 |
| WO | 2019070436 | A1 | 4/2019 |

OTHER PUBLICATIONS

PCT Search Report, dated Apr. 5, 2023, International Bureau of WIPO.

* cited by examiner

DYNAMIC MOTION FORCE SENSOR MODULE

This application is a Divisional of U.S. patent application Ser. No. 18/077,464, filed Dec. 8, 2022, entitled "DYNAMIC MOTION FORCE SENSOR MODULE," which is a Continuation In Part of U.S. Pat. No. 11,628,337, filed Sep. 27, 2021, entitled "DYNAMIC MOTION RESISTANCE MODULE," which is a Continuation of U.S. Pat. No. 11,161,012, filed Apr. 21, 2021, entitled "DYNAMIC MOTION RESISTANCE MODULE," which claims priority to U.S. Provisional Patent Application No. 63/014,191 filed Apr. 23, 2020, entitled "DYNAMIC RESISTANCE EXERCISE MODULE" and are hereby incorporated by reference herein.

FIELD OF THE INVENTION

Embodiments described herein generally relate to a modular dynamic force module used to vary unique dynamic forces during different forms of physical activity. More specifically, a unique torque sensor module included within the dynamic force module that provides real-time tracking of forces applied during exercise of physical activity, for example.

BACKGROUND OF THE INVENTION

Dynamic and varying forces used during physical activity maximize efficiency and reduce the potential for injury or strain versus static weights or dedicated electromechanical exercise systems.

Some exercise machines utilize resistance mechanisms, such as U.S. Pat. No. 6,440,044. However, U.S. Pat. No. 6,440,044 is limited in the amount of resistance it can provide for a user. Further, the resistance mechanism is based on counterweights rather than by force created by the user. This makes the user more prone to overworking their muscles and makes the user more susceptible to injury.

U.S. Patent Publication No. 20030027696, teaches a cable machine having weight stacks attached to a cable. A pulley system is utilized which is limited in the range of motion that can be used and can cause a user to overly isolate a single muscle which could result in injury.

Resistance bands, such as U.S. Design Patent No. 750,716, can be attached to different equipment to provide a variety of forces in varying ranges of motion, however, the resistance is limited based on the quality of the band. Furthermore, the resistance created using the bands is static throughout physical activity.

U.S. Patent Publication No. 20080119763 teaches a system for acquiring, processing and reporting personal exercise data on selected muscle groups by measuring vector force from at least one muscle or muscle group acting on physical exercise equipment. It provides the user with information so that the user can make manual adjustments to the exercise equipment.

U.S. Patent Publication No. 20200151595 discloses processing sensor data to improve training for the user. The invention provides the user with feedback and recommendations to make form and manual resistance adjustments for subsequent modifications of training regimens.

U.S. Pat. No. 10,661,112, discloses digital strength training using information received related to the position of an actuator coupled to a cable which is coupled to a motor.

The prior art fails to provide an open hub modular dynamic motion resistance module that analyzes real time data to provide automatic real time adjustments of experienced forces. The present invention improves the efficiency of physical activity, such as exercise, is more accurate and reduces injury and strain to the user.

SUMMARY OF THE INVENTION

The present invention provides a system and method for improving the efficiency and accuracy of real-time forces used to adjust the experienced forces during physical activity.

The Dynamic Motion Resistance Module ("DMRM") and method of creating varying forces is an improvement to the prior art because it uses variable torque force (e.g., DC motors, Eddie currents, friction clutch or torsional sensors) that is converted to a linear force and controlled by a microprocessor, receiving adjustments based upon a variety of sensors and calculated optimized forces. This allows a user to perform physical activity, such as exercise, based on his or her unique ability creating the varying force based on the amount of force the user is able to apply. The force may vary within a single repetition or a set of exercise if the user's applied force capacity fluctuates within the activity. The DMRM is particularly helpful for users recovering from injuries and conscious of not overworking muscles.

Exemplary embodiments disclosed herein describe a module that provides for a dynamic force control, that is electromechanically controlled in a closed loop apparatus (Mechanical, Electrical, Software) that can vary the relative forces a user experiences and adapts to the individual during physical activity, such as a workout or therapy session, based on a variety of input variables. The input variables include repetition rate, recovery period, current physical activity profile, daily goals, historical guidance, and AI adjustments. The input variables may be received from an associated mobile application on a user's device, or from the force module. The DMRM is unique from other physical activity equipment, such as static Olympic weight plates, because it is a modular system that uses variable torque force to create dynamic forces for the user in real-time. Thus, the DMRM may be used as a replacement module to static weight plates.

The DMRM improves a user's physical activity through adaptation and adjustment of forces, based upon inputs from a variety of one or more sensors and calculated adjustments to optimize each physical activity and force efficiency. The sensors may include Hall Effect (and/or accelerometer, gyro meter, magnetometers, optical, etc.) for position, Strain Gauge (for example, Force Sensitive Resistor, Piezo, optic, or torsional sensor) for forces, contact closures or proximity detection for safety interlocks or motor control.

The DMRM can be attached to many Olympic or standard Barbell and Dumbbell components or other exercise equipment to add dynamic forces to an otherwise static mass.

The DMRM may be mounted in unique ways. It may be profiled and used for static force routines with programmable forces and hold times, adapted to the daily physical activity or to add the same elements of closed loop force adjustments to other physical exertion applications and therapies.

The present invention provides a modular and dynamic force apparatus for adjusting standard and dynamic torque-to-linear forces during physical activity in real-time, with the apparatus including a force module, a user device and an apparatus tracking processing unit. The force module includes an open hub attachment point, wherein the open hub attaches the apparatus to an external source, one or more sensors measuring data for physical activity efficiency, an internal processor, wireless radio and force sensor module, a variable length cable, a force generating component, and motor controls. The internal processor, wireless radio and force sensor module includes an apparatus tracking measurement unit ("ATMU") adapted to measure data, a first electronic communications channel for transmitting the measured data to an apparatus tracking processing unit ("ATPU"), and a second electronic communications channel for transmitting one or more apparatus conditions data to adjust dynamic forces. The user device receives one or more apparatus conditions data over the second electronic communications channel for real-time notification and/or adjustments to the user. The user interface can include a display that provides user feedback and an apparatus tracking processing unit ("ATPU"). The ATPU includes the first electronic communications channel for receiving the measured data from the ATMU and motor controller, a microprocessor, a memory storage area, a database stored in the memory storage area, and a tracking processing module located within the memory storage area. The database stores a first set of evaluation rules and a second set of evaluation rules, the first set of evaluation rules corresponding to one or more tracking parameters, and the second set of evaluation rules corresponding to the one or more apparatus conditions. The tracking processing includes program instructions and algorithms that, when executed by the microprocessor, causes the microprocessor to determine the one or more tracking parameters using the measured data and the first set of evaluation rules, and determine the one or more apparatus conditions data using the one or more tracking parameters and the second set of evaluation rules.

The present invention also provides an improvement to the DMRM's sensing and transmitting of torsional forces. A torque sensor module of the present invention embeds and provides real-time feedback from lever-based strain gauge load cells packaged within an electromechanical motor, flywheel, or other static resistance sections. The compression forces are converted to torque forces and can be used to provide closed loop motor control of user experienced forces, during exercise or other physical activity. This arrangement of a rotor, wirelessly communicating sensor force and positional data to the stator controller of an electromechanical motor has applications to other portable, e-vehicle hub motors and electro-mechanical or physical work use cases.

The present invention provides a torque measurement system for providing real time tracking and motor control for adjusting standard and dynamic torque-to-linear forces in an electromechanical motor, the system including one or more sensors for measuring data, one or more load wedges affixed to a rotor, a slip bearing for measuring forward and reverse forces of the rotor section, a tracking measurement unit adapted to measure raw data, a wireless radio, an internal processor, and a tracking processing unit. The tracking processing unit includes program instructions and algorithms that are executed by the internal processor to determine one or more tracking parameters using raw data measured by the tracking measurement unit, a first electronic communication for receiving the measured data via the wireless radio from the tracking measurement unit, and the second communication channel for transmitting one or more apparatus conditions data from the tracking processing unit to a controller of the electromechanical motor to adjust dynamic forces.

The present invention also provides a method for measuring bi-directional torsional forces for adjusting standard and dynamic torque-to-linear forces on an electromechanical torsional force generating device in real-time, the method including attaching force transducing load cells arranged in a Wheatstone bridge wired configuration, wherein the load cells convert a compression force vector into a rotational torque vector, determining activity data measurements using the force transducing load cell arrangement, transmitting the activity data measurements to a processing unit for analysis according to predetermined sets of evaluation rules, applying one set of evaluation rules to determine at least one apparatus condition parameter using at least one tracking parameter, transmitting at least one apparatus condition parameter to a motor controller of the electromechanical torsional force generating device or a user device, providing real-time control of at least one apparatus condition parameter using the user device, and adjusting, in real-time, the torque-to-linear forces experienced by the user or load by the electromechanical torsional force generating device.

BRIEF DESCRIPTION OF THE DRAWINGS

The various advantages of the embodiments of the present disclosure will become apparent to one skilled in the art by reading the following specification and appended claims, and by referencing the following drawings, in which:

DETAILED DESCRIPTION

The DMRM's unique modular functionality allows it to attach or mount to various traditionally used force equipment (e.g., barbells, racks, benches) as well as use in other physical activities. The DMRM includes a full closed/feedback loop motor control of adjustment and refinements based upon the user's dynamic or profiled reaction to the force being performed, in real-time. This allows the user to utilize numerous muscle groups at once in an almost limitless number of physical activity forces and ranges of motion.

The varying forces are based on applied user force and limits the likelihood of injury. Furthermore, the present invention has less mass than the traditional static weight plate equivalent, therefore, accidentally dropping the apparatus on a toe or finger, would likely cause less injury to the user. The DMRM is accessible to users of various strength levels and can be easily transported. The modularity, combined with the novel means of replicating varying forces, and the lighter mass make the DMRM unlike any other force equipment.

The DMRM may be used for a variety of types of physical activity. This includes exercise, boundary constraints, safety modules and two-person interactive activities, in varying configurations and mounting positions.

Figure 1:
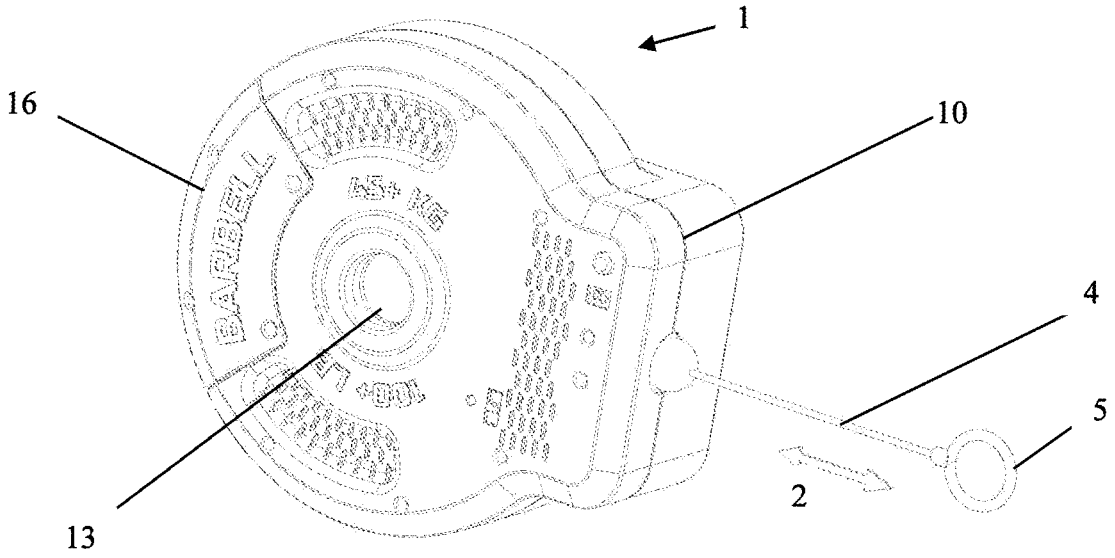
FIG. 1 shows an exemplary DMRM configured to operate according to an embodiment of the invention for use with force equipment commonly found at professional workout studios or home gyms.

FIG. 1 shows an example of a modular, standalone Dynamic Motion Resistance Module 1. Although some of the exemplary embodiments described herein are tailored to a stand-alone module, the present disclosed apparatus and methods are not limited to this configuration and can be used in other apparatus environments using similar applications and methods. One or more modules may be mounted or anchored to the equipment being used.

As illustrated in FIG. 1, the apparatus includes an open hub 13, that is sized to fit on varying types of equipment, such as Olympic or standard Barbell and Dumbbell components. The outer shell 10 houses the dynamic force components including a motor, such as a DC motor, a power source, a smart controller/wireless communication, sensors, an embedded processor and a cable or strap spool 4. The module may also include a display. Cable or strap spool 4 of the DMRM 1 provides a connection point 5 to attach hand grips, bars, or fixed points for the user to use the attached module. Sensors may include Hall effect, strain gauge, or safety interlocks as well as external physiological sensors such as heart rate, forces, timing, workout form, calorie burn, workout repetition speed and workout history. The force sensors are located within the logical force sensor module however, the exact physical location may vary for applications other than DMRM specific. The sensor feedback may be audible, tactile and/or haptic. DMRM 1 is fitted onto internal rotational part 13 providing varying forces to the strap or cable 4 in a linear direction 2, such that the user experiences a varying force based upon sensor control and calculated inputs to optimize the physical activity session. DMRM 1 also accommodates placard and branding space 16.

Figure 2:
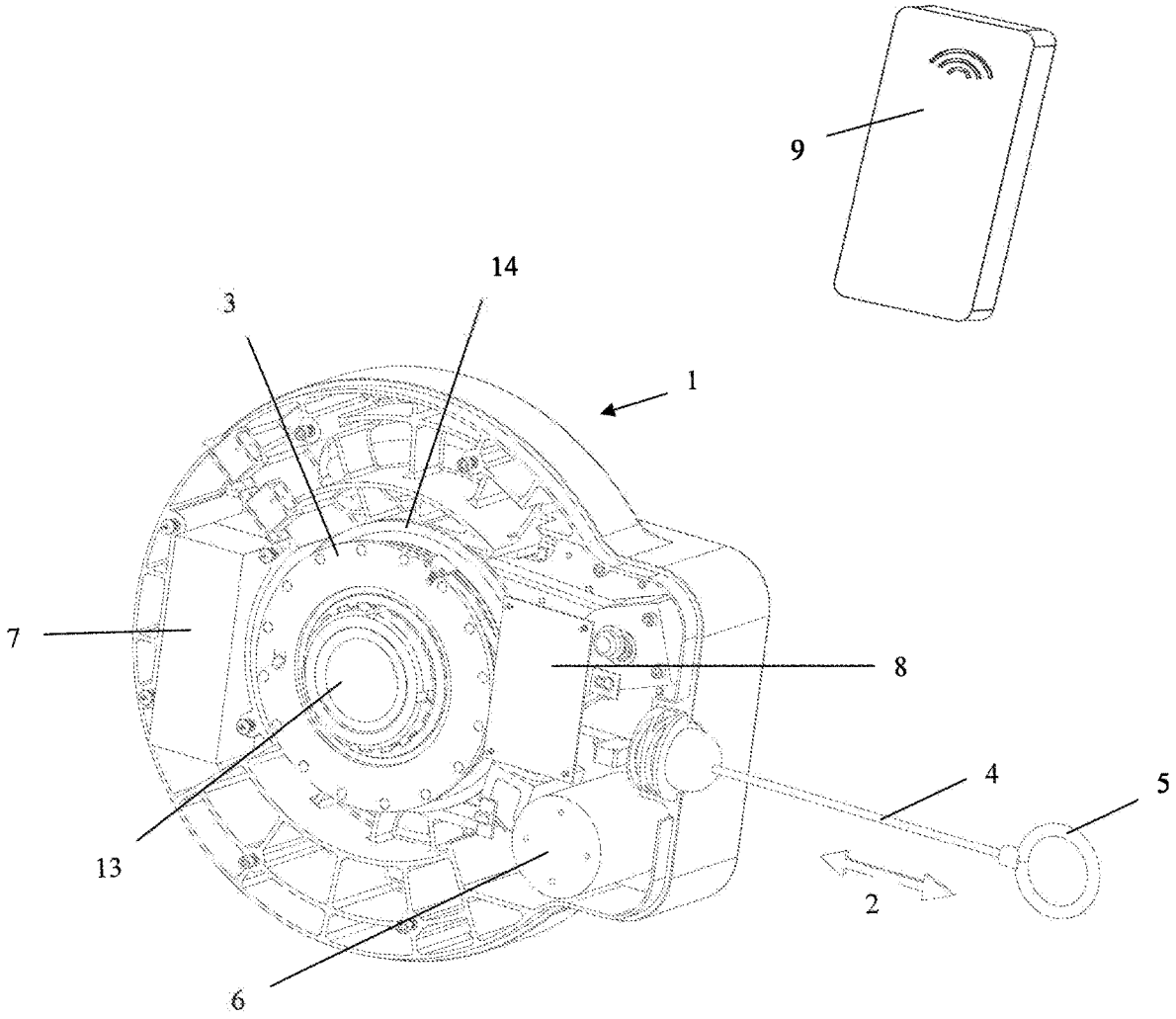
FIG. 2 shows an exemplary internal view of the DMRM.

FIG. 2 shows an exemplary illustration of the inside of DMRM 1 and internal force functionality demonstrating the major components applied in delivering the dynamic forces including the resulting linear vector of force 2, created by the internal rotational 3 force and a typical communication device 9 sending the commands for varying forces to the module. The torque-to-linear force is generated by the motor, gearing, pulleys, or Eddy force component 6, powered by a supply source 7, for example, batteries or line power. The forces and communication are handled by an internal processor, wireless radio, and force sensor module 8 ("force sensor module") acting both as an apparatus tracking measurement unit ("ATMU") and a self-contained integrated DMRM (offline/manual mode) alternately receiving control commands from a commercially available external device 9, acting as an apparatus tracking processing unit ("ATPU"). The ATMU measures apparatus/module data and uses an electronic communications channel to transmit the measured data to the ATPU. A second electronic communications channel is used by the ATMU to transmit one or more of the apparatus conditions data to the user interface to adjust dynamic forces. The user interface, either local on the device or an associated application, is used to adjust all forces and physical activity profiles. The ATPU includes a microprocessor and a memory storage area. The memory storage area includes a database and a tracking processor module. The tracking processing module includes program instructions and algorithms that, when executed by the microprocessor, determines one or more tracking parameters using the measured data and a set of evaluation rules and the apparatus and/or module conditions measured by the ATMU, using one or more of the tracking parameters and another set of evaluation rules. The database stores the sets of evaluation rules. At least one set of rules corresponding to one or more of the personal tracking parameters, such as repetitions per minute, total repetitions, calories burned, and goals achieved, another set of evaluation rules corresponding to the one or more conditions of the apparatus and/or module.

The embedded processor of module 1 monitors the electronic motor control loop, sensor management and wireless communications, such as Bluetooth Low Energy (BLE), Wi-Fi or cell. The embedded processor provides local control and calculations and variables, such as main power, timers, motor control profile, start/stop, effective forces, and safety interlock status. It can also provide the ATPU with calculated or raw data so higher-level calculations can be performed at either boundary of the architecture. The ATPU is a logical element that may be physically located within the DMRM or in the user interface. The ATPU transmits the apparatus conditions such as battery charge status, safety status and system health. The optimized linear forces are directed to cable or strap 4. Cable or strap 4 includes an attachment point 5, such as a cleat, an eyehook or other common or custom attachment points, to allow a variety of accessories and attachment options to cable or strap 4. When the module is "off-line" it can be in either low power sleep mode or powered off.

Figure 3A:
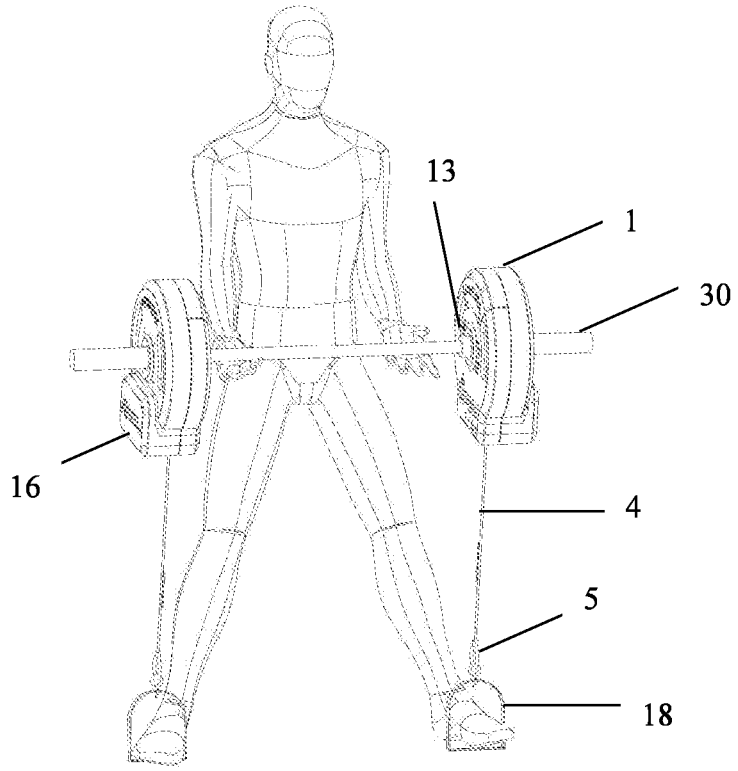
FIGS. 3*a* and 3*b* show an exemplary use with the DMRM.
Figure 3B:
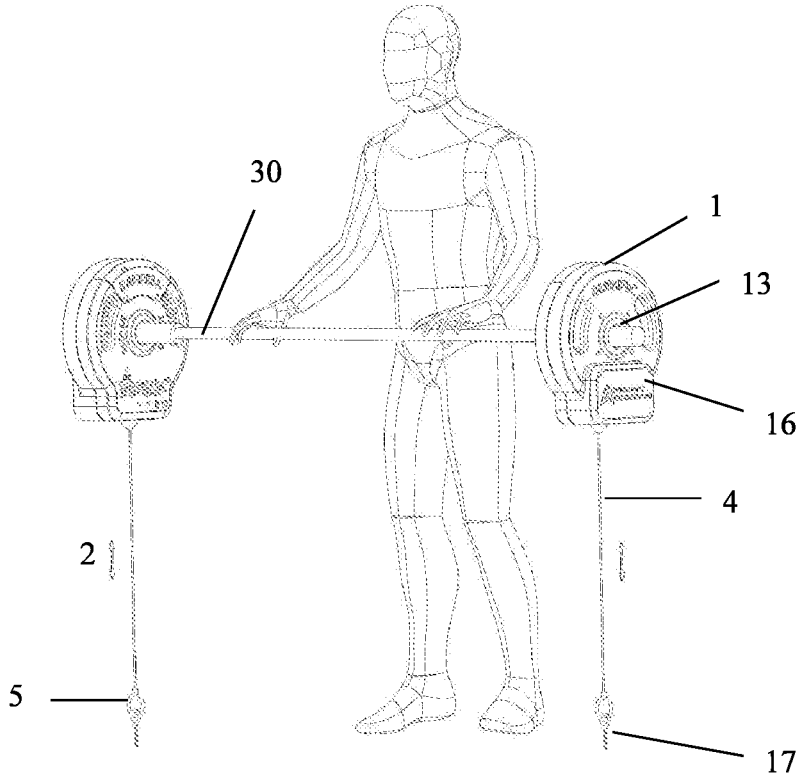

FIGS. 3*a* and 3*b* illustrate an embodiment of the DMRM 1 in practice with application of forces and internal force functionality mounted on a typical exercise barbell or dumbbell rod 30. The resulting vector of force 2 may be accommodated by an internal Industry Standard/Common Barbell or Dumbbell rod 30 or other common hub adaptations for the module to connect/mount. Strap or cable 4 and attachment point 5 are in a linear direction, such that the user experiences a varying force based upon rate, form, pre-planned exercise routines, sensor and/or calculated inputs to optimize a physical activity session. DMRM 1 includes multiple safety mechanisms, such as cable safety stops (cut-off switch), anchor points (foot anchor 18 in FIG. 3*a* or floor anchor 17 in FIG. 3*b*), and/or hardware/software control loops and feedback loops (Sensor, Electronic, Software) for a real-time closed loop controlled and dynamic force application. Foot anchors 18 counteract the applied forces for a dynamic free weight experience.

Figure 4A:
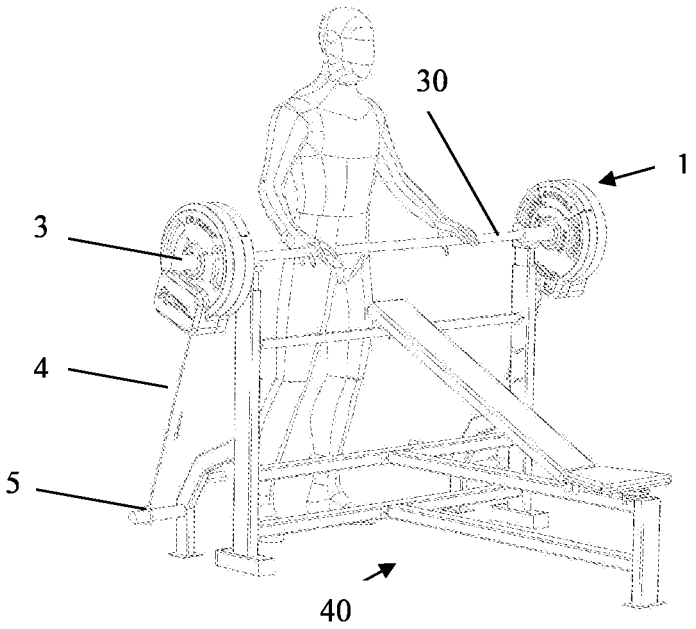
FIGS. 4*a*, 4*b* and 4*c* show an exemplary use of the DMRM with an exercise bench.
Figure 4B:
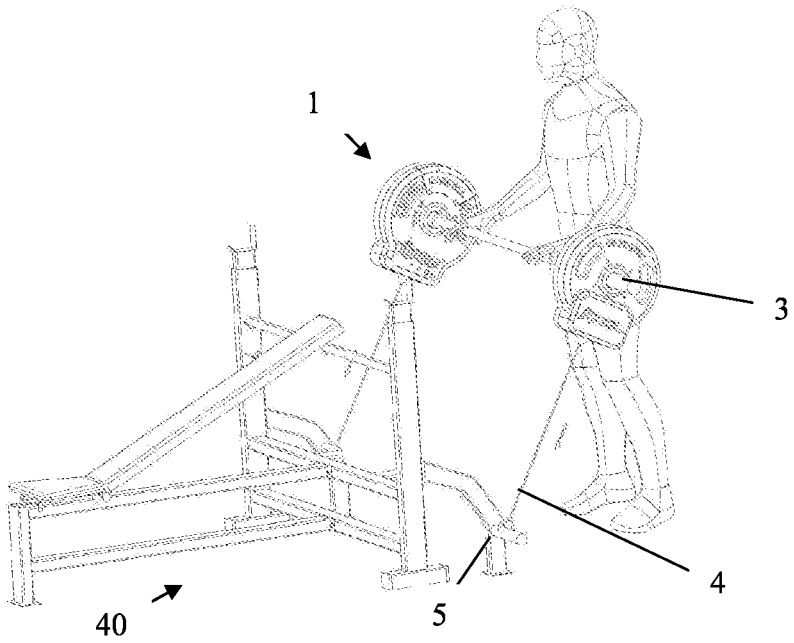
Figure 4C:
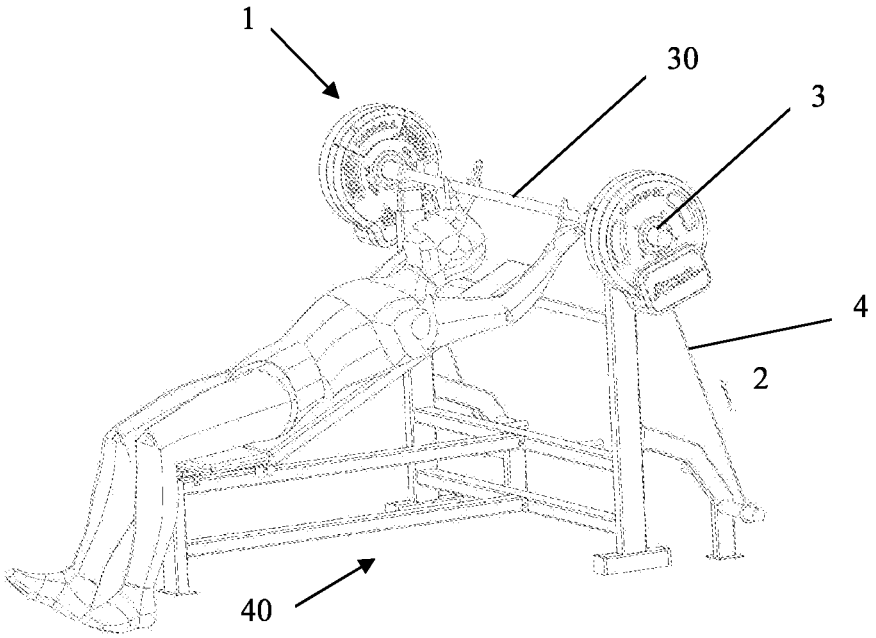
Figure 5:
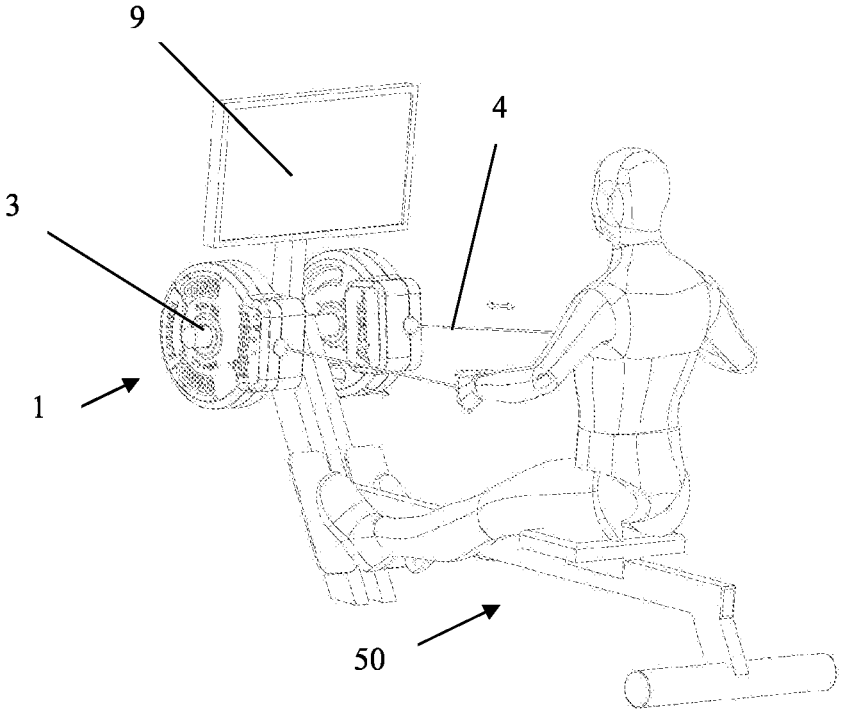
FIG. 5 shows an alternate use of the DMRM with the user pulling the variable force cable on a rowing machine.

FIGS. 4*a*, 4*b*, and 4*c* illustrate DMRM 1 being used with weight bench 40. DMRM 1 is mounted on bar 30. The user is able to perform a variation of exercises with different ranges of vector of force 2. FIG. 5 illustrates the use of DMRM 1 on rowing machine 50. The user interface 9 can be part of the rowing machine or can be a separate user interface such as a smartphone. Two DMRM 1 are attached to rower 50, however the number of modules attached to the equipment can be one or more. The user pulls on cables 4 while rowing on rowing machine 50 and receives real-time feedback and a haptic sensation of actually rowing in water.

Figure 6:
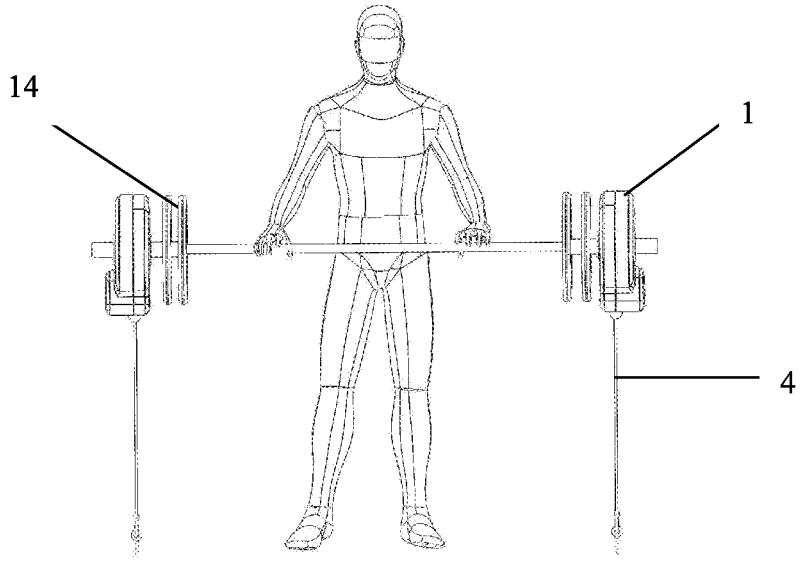
FIG. 6 shows an alternate use of the DMRM with the user pulling the variable force cable.
Figure 7:
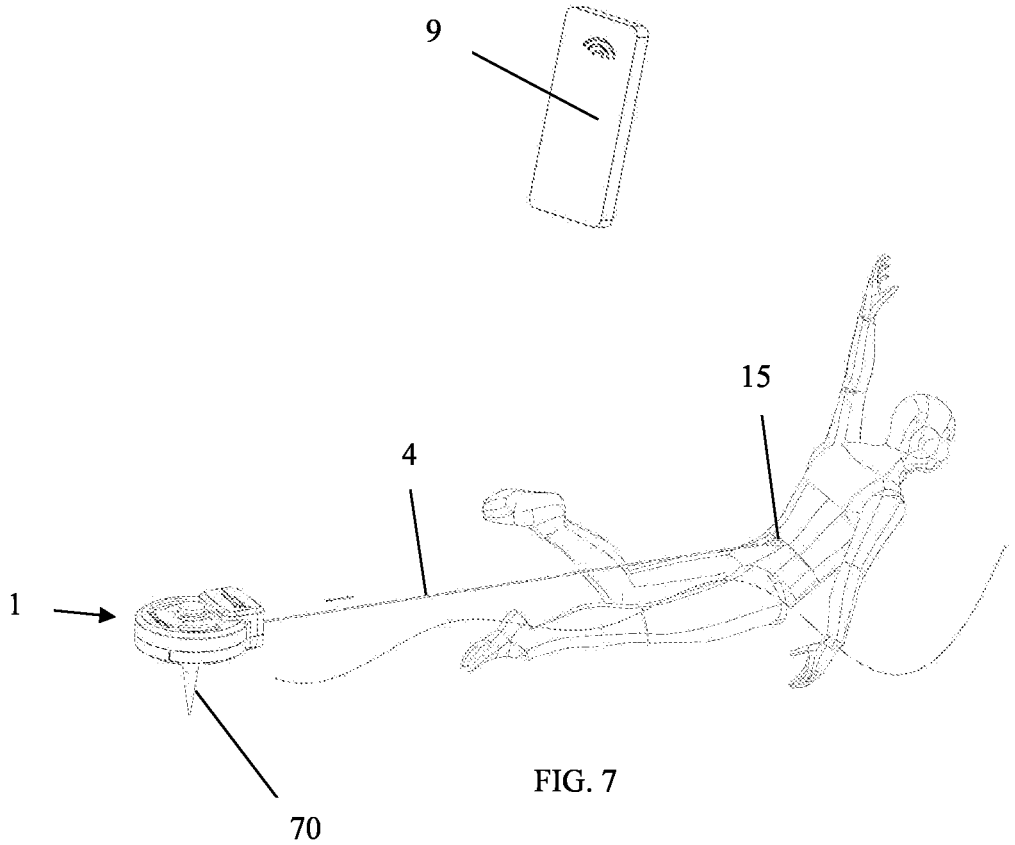
FIG. 7 shows an alternate use of the DMRM with the user pulling the variable force cable while swimming.
Figure 8:
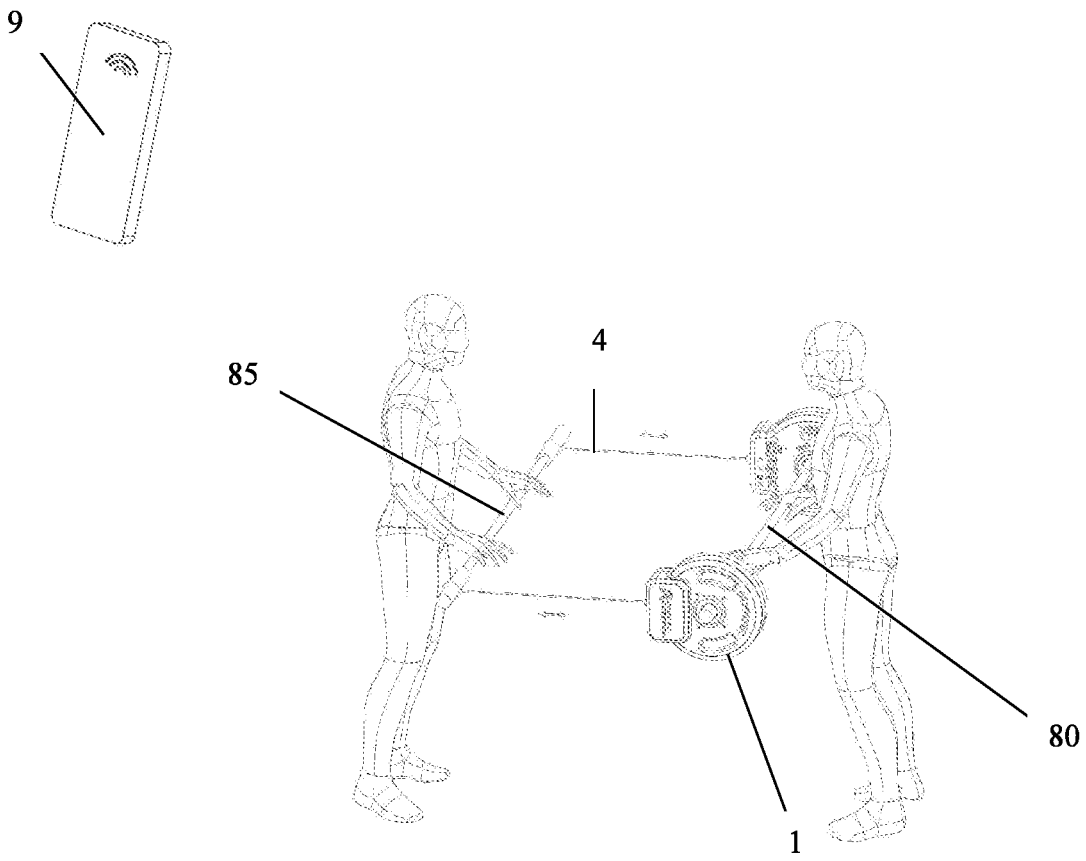
FIG. 8 shows an alternate use of the DMRM with two interactive users.
Figure 9:
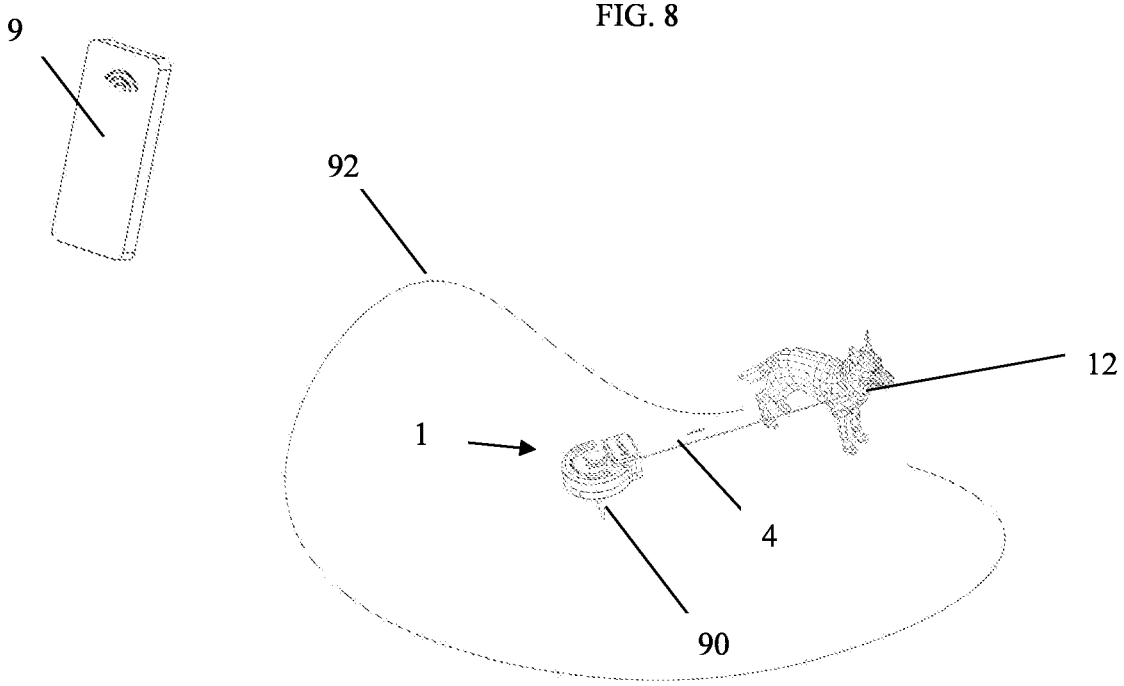
FIG. 9 shows an alternate use of the DMRM with a pet.

FIGS. 6, 7, 8 and 9 show exemplary illustrations of additional uses with DMRM 1. In addition to mounting the DMRM to traditional exercise equipment, static weight plates 14 may be added as seen in FIG. 6. DMRM 1 may be mounted in other ways, for example, DMRM 1 may be mounted to one or more anchor points 70 on a load bearing structure and then attached to a swimmer's harness 15 to adjust or measure dynamic physical activity force while swimming (FIG. 7). As seen in FIG. 8, DMRM 1 may also be used for two-person interactive exercises or therapy activities. One user holds the onto barbell 80 where two modules are mounted, for example, while the other user attaches a barbell (or other form of equipment) 85 to strap or cable 4 via attachment point 5. Another example, shown in FIG. 9, attaches DMRM 1 to an animal or pet by a harness or leash 12, for example. DMRM 1 provides freedom of movement for the animal, unless the animal reaches the user set boundary. Once the set boundary 92 is reached, dynamically applied forces begin to apply resistance leading to a full stop (a hold or lock mode, for example) at a controlled length and containment.

Figure 10:
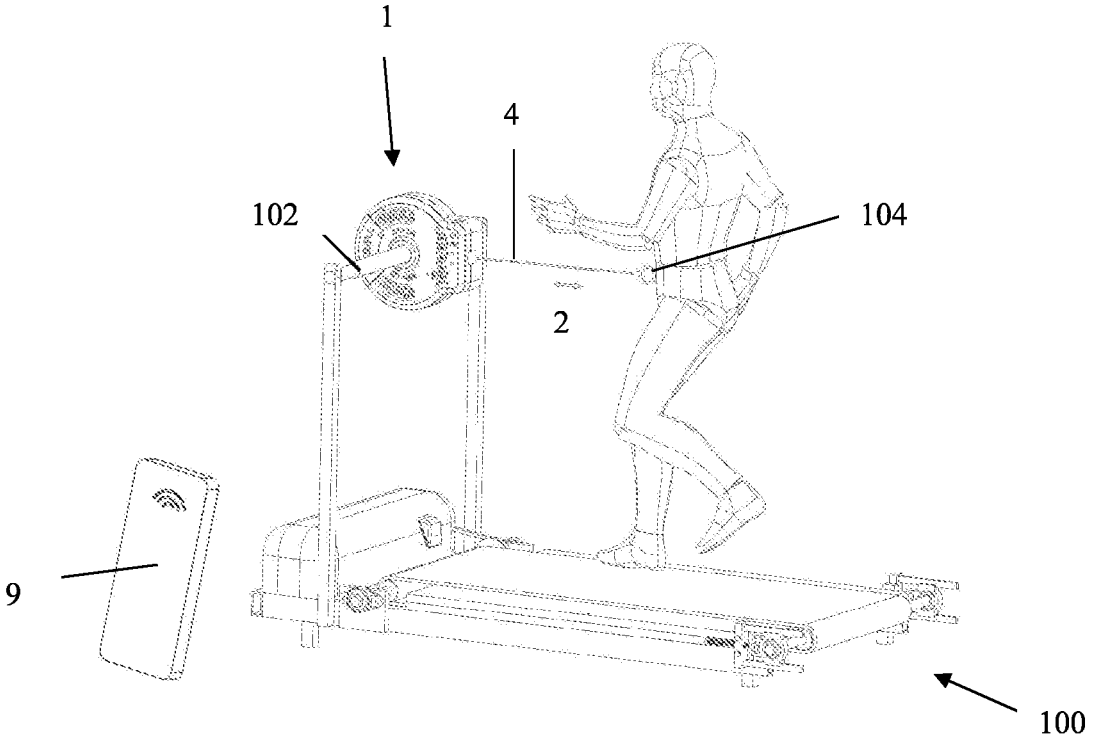
FIG. 10 shows an alternate use of the DMRM on a treadmill.
Figure 11:
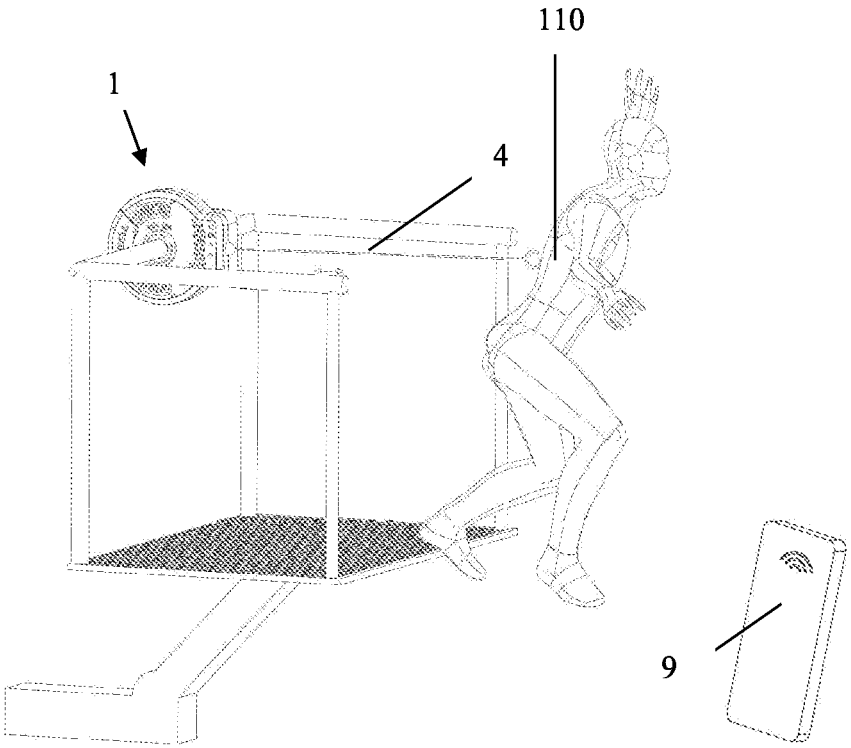
FIG. 11 shows an alternate use of the DMRM as a safety module.
Figure 12:
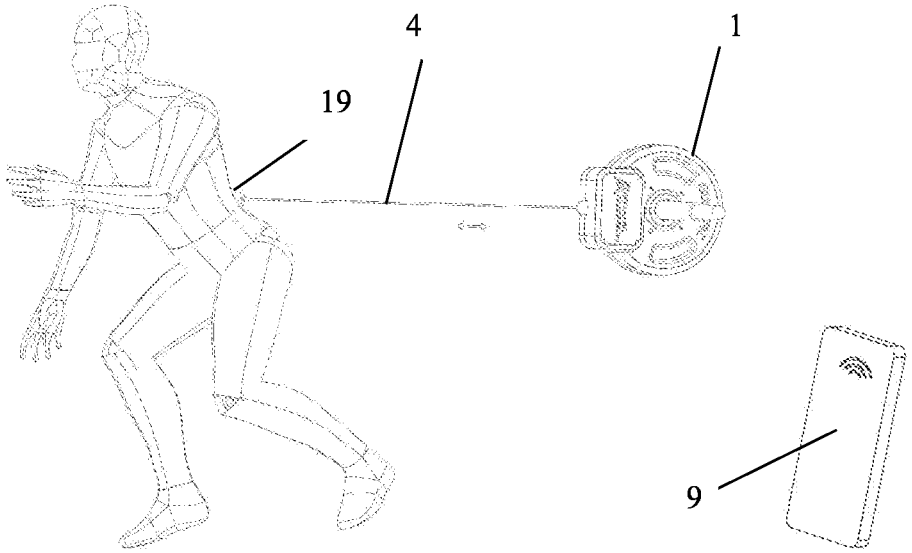
FIG. 12 shows an alternate use of the DMRM with the user pulling the variable force cable.

FIGS. 10, 11 and 12 provide additional alternate uses of DMRM 1. FIG. 10 shows attaching DMRM 1 to treadmill 100 at attachment point 102 and attaching cable or strap 4 to the user's waist by a harness or other connection point 104 keeping the runner perfectly centered on treadmill 100. DMRM 1 may also be used as a safety arresting module, such as in FIG. 11, attached to a user at connection point 110, such as a harness, providing freedom of movement to the user (human or animal). If, or when, a spurious force is detected, such as a fall or trip, the apparatus holds or locks, securing the user. FIG. 12 illustrates use by a sprinter or skater in which DMRM 1 is attached to the user by a harness or other connection point 19 during training. The apparatus senses and controls the applied forces to the user. The module can additionally be profiled and used for static force routines with programmable forces and hold times, adapted to the daily physical activity or to add the same elements of closed loop force adjustments to other physical exertion applications and therapies.

The sensors discussed above may be packaged separately as a force sensor module, and, when used within the DMRM, provide real-time measurement and tracking of forces experienced by the user at the tangent force vector. This allows the user to utilize numerous muscle groups at once in an almost limitless number of physical activity forces and ranges of motion. The varying forces are based on applied user force and limits the likelihood of injury, although a user has the option to set a desired static force. A force sensor module may be used within the DMRM as discussed above, or in other electromechanical motors, such as an e-bike. The force sensor module is a torque measurement system that provides real-time tracking and motor control for adjusting standard and dynamic linear-to-torque forces. The measurement system of the force sensor module includes a unique arrangement of single axis levered load cells, such that rotational force can be measured. The packaging of either a half or full Wheatstone bridge analog measurement from the load cells can be accurately calibrated and tracked for forward and reverse torque, at the point of tangential conversion. The Force Sensor Module is functionally comprised of the ATMU and ATPU modules, sensors, an internal processor, wireless radio, a power source and a user interface. The sensors section may include Hall Effect (and/or accelerometer, gyro meter, magnetometers, proximity, optical/proximity sensors) for positional information, Strain Gauges/Load Cells (for example, Force Sensitive Resistor/Common Load Cells, Piezo, optic, or torsional sensor) for forces, contact closures or proximity detection for safety interlocks and the motor controls. Torque-to-linear forces are measured during physical activity in real-time, with the apparatus including a force sensing module, an electromechanical motor, processors, and a user interface device. When integrated, the system includes one or more sensors measuring data for physical activity efficiency, the force sensor module, a variable length cable, a force generating component, and the closed loop motor controls. The force sensor module communicates the measured resistance at the point of tangential dynamic forces, experienced by the user at the end of a cable/strap or at the DMRM mounted position.

The ATPU, which is part of the force sensor module, includes the first electronic communications channel for receiving the measured data from the ATMU, a motor controller, a microprocessor, a memory storage area, a database stored in the memory storage area, and the logic forming a tracking processing module. All of the logical components of the ATPU may be located separately or combined into one circuit board. The ATPU will determine the rate, cable length and resulting force, when the user applies a counter force to a prescribed exercise mode and current user settings. Within the ATMU is a torque sensor module that provides real-time feedback from lever-based load cells, such as strain gauge, packaged within an electromechanical motor, flywheel or other static resistance sections. The rotor has torsional freedom of motion in rotational motor direction. A load wedge is connected to the rotor and transfers the rotational force of the rotor motion to the levered section of the load cells, forming compression forces. The compression forces (measured as a voltage drop across a resistance) are converted to torque forces and can be used to provide closed loop motor control of user experienced forces, during a physical activity. The raw analog load cell data (arranged as Half or Full-Bridge) is converted by the ATMU using a Digital To Analog (DAC) converter and can be wirelessly communicated to the ATPU for further processing.

In an embodiment of the force sensor module of the present invention, a slip bearing is formed between a motor rotor and a load cell mounting ring, allowing the forward and reverse forces to be measured. The load cells may be mounted on opposing angles and relative to the rotational center axis. A load wedge may be attached to a rotor section of the motor at a tangential transition, such that a force is applied to the load cell levered section. One load wedge may be used for a half bridge configuration and two load wedges for a full bridge configuration. The force sensor module may be packaged within a DMRM or used in similar applications where sensor information is wirelessly communicated between a rotor and stator. This wireless communication between the rotor and stator of the present invention can be used within motor control applications involving positional, rotational speed and force sensor communications. The tracking process includes program instructions and algorithms that when executed by a microprocessor, causes the microprocessor to determine one or more tracking parameters using the raw data measured by the ATMU. For example, sending control signals to the resistance generating component of a user device with a first set of evaluation rules, and determining one or more apparatus condition parameters, using one or more previously established tracking parameters, with a second set of evaluation rules.

The flow and functionality of the force sensor module system is as follows: The ATPU receives digital force and positional information from the ATMU and sensors, such as Hall Effect Positional Data, Voltage, Current Usage, Speed, and other secondary motor parameters from the motor controller. The ATPU filters, prioritizes, processes, and provides motor control parameters back to the controller for the next set points. The communication and control are tightly coupled for minimal signal delay and therefore can provide dynamic feedback during physical/work activity, thus feeling seamless to the user's experience. The present invention simulates real-world forces such as rowing, swimming, runner start force and other physical work-related activities as a learn, replicate and improve simulation. This arrangement of the force sensor module of the present invention having a rotor wirelessly communicating sensor force and positional data to the stator controller of an electromechanical motor can be used in other portable, e-vehicle hub motors and electro-mechanical or physical work use cases. For example, with an e-bike hub motor, the e-bike hub motor could be adapted to include this unique self-contained force sensor module system, in place of the current state of the art, having a torque sensor in the pedals and the power supply external to the electromechanical motor section. Th present invention provides the capability to wirelessly communicate information to/from the spinning rotor to the stator section of the motor. This is an improvement to the prior art and saves cost on complicated mechanical slip bearings and packaging challenges.

Figure 13:
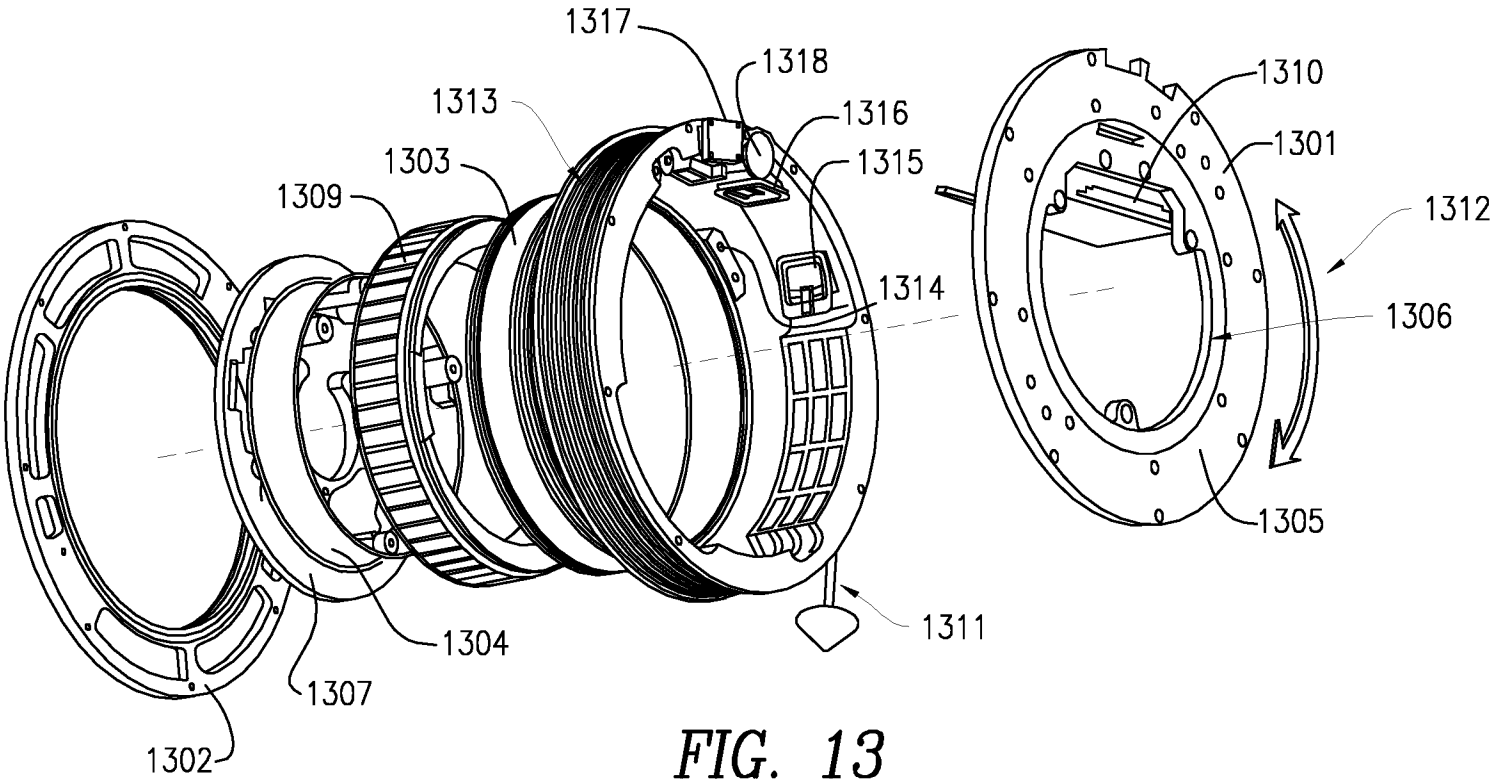
FIG. 13 shows an exemplary embodiment of the inner workings of a DMRM.

FIG. 13 shows an exploded view illustrating the inner workings of a DMRM utilizing the force sensor module configuration. Front rotor cover 1301 and back rotor cover 1302 are affixed to magnet rotor ring 1303. Front stator cover 1306 and back stator cover 1307 are affixed to open hub stator 1304. The rotors move around the axis of rotations formed at open hub stator attachment 1304, utilizing slip bearing interface 1305. Magnet rotor ring 1303 is driven by the electromagnetic forces generated within coil stator 1309 by motor controller 1310. This combination of parts, when driven by motor controller 1310, forms a motor assembly with the cover plates providing the torsional functionality desired. Although some of the exemplary embodiments described herein are tailored to a DMRM, for example open versus closed hub, the present force sensor module and methods are not limited to this configuration and can be used in other apparatus environments with similar applications and methods.

As illustrated in FIG. 13, the apparatus includes open hub stator attachment 1304, that is sized to fit on varying types of equipment, such as Olympic or standard Barbell and Dumbbell components. A cable or strap can be attached in tangent force direction 1311 such that it will experience converted torsional rotation force 1312 applied from the motor section described within. The force sensor module configuration includes load cell ring 1313 floating relative to front rotor cover 1301 and back rotor cover 1302, while providing freedom in the rotational axis. Load wedge 1314 is affixed to magnet rotor ring 1303 such that it is captured between forward load cell 1315 and reverse load cell 1316. In this arrangement the rotation force can be transferred to the tangent force and sensed as a compression force applied to the otherwise levered sensing capability of the strain gauge-based load cells. Forward load cell 1315 and reverse load cell 1316 are wired in a half Wheatstone bridge electrical profile providing an analog input signal to load cell amp 1317. Load cell amp 1317 converts this parameter to a weighted analog-to-digital ADC output and provides the raw sensor data to wireless device 1318 or slip connector for further processing, filtering, and tracking on a computer or other user devices.

Figure 14:
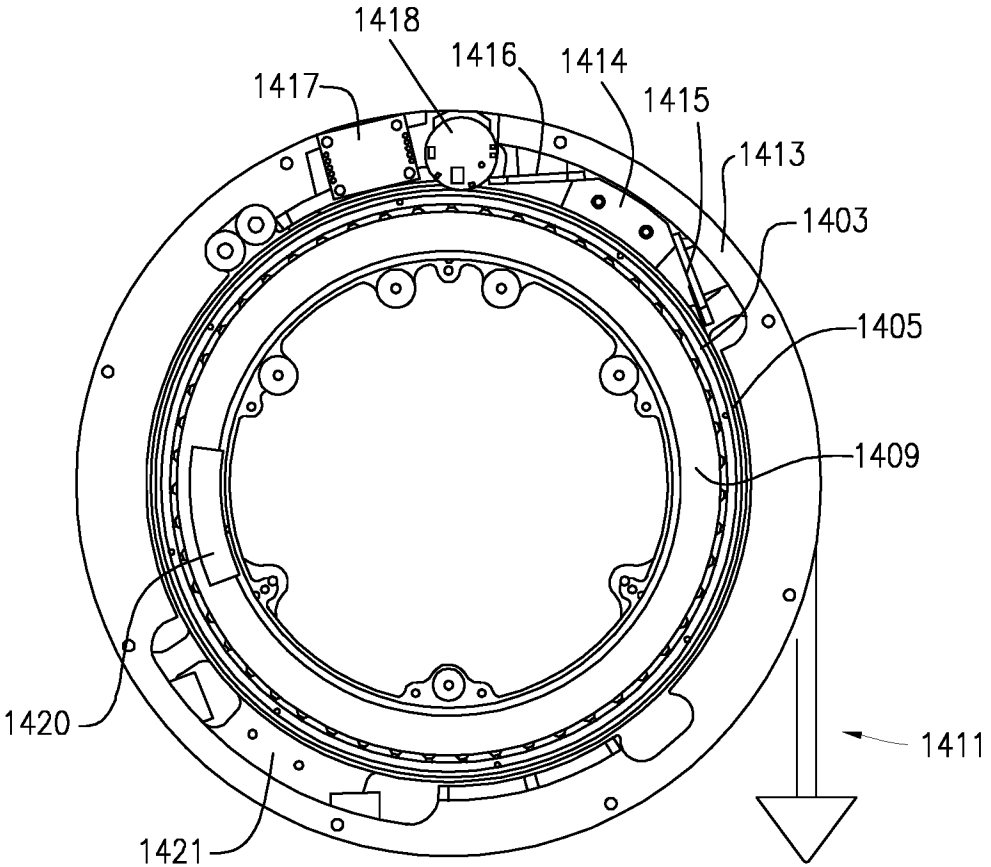
FIG. 14 shows a front view of an exemplary embodiment of a force sensor module.

FIG. 14 shows an alternate exemplary embodiment of a front view of a force sensor module configuration. Slip bearing interface 1405 is formed between coil stator 1409 and magnet rotor ring 1403 with load wedge 1414 affixed to magnetic ring 1403. This view further illustrates an alternate embodiment of adding a second forward load cell 1415 and second reverse load cell 1416 in a full Wheatstone bridge electrical schema as an alternate mount 1421 position, thus adding further accuracy of measurements. The resulting forces experienced at load cell ring 1413 when counter forces are applied in the tangent force direction 1411 are sensed by the compression forces experienced by the load cells. As previously described, these forces are converted by load cell amp 1417 and communicated by wireless device 1418 or slip connector interface to a computer or other user devices, for further processing, filtering, and tracking. Further accuracy can be realized with the force sensor module by utilizing positional data from the optional multi-axis sensors within wireless device 1418 and/or a supplemental hall effect positional sensor 1420. The positional data supplements the tangent force 1411 tracking, forming a weighted force vector and calculating the length of cable or strap released or retracted. When combined with a clock timer, these data sources provide rate, position and force which provide complete sensing and closed loop control of dynamic forces in real-time.

Figure 15:
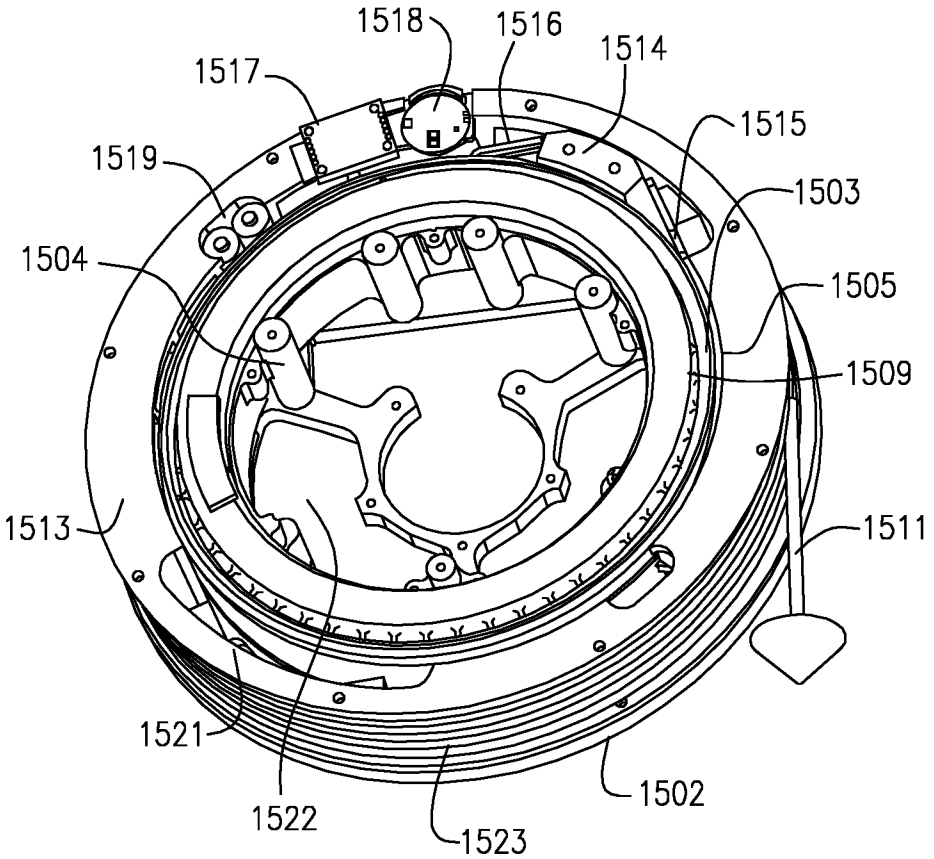
FIG. 15 shows an isometric view of an exemplary embodiment of a force sensor module.

FIG. 15 shows an isometric view illustrating the inner workings of a DMRM utilizing the force senor module configuration. When the force sensor module incorporates wireless device 1518, a separate rotating low-power supply 1519 may be used to power load cell amp 1517 and wireless device 1518. Alternately, the devices can be powered through a slip connector, packaged within slip bearing interface 1505. In both cases, the commercially available devices are very low power, with sleep and chip enabled capabilities for long life usage prior to needing replacement or charging, should batteries be used as the power supply. The higher demand electromagnetic motor characteristics described previously can be powered from a power supply, such as a battery pack, fuel cells, rechargeable power, or fixed power supply, in stator power supply area 1522. The stator power supply is packaged and affixed within a closed hub or open hub stator 1504 and coil stator 1509.

FIG. 15 further illustrates the force sensor module system functionality. As demonstrated in this view, load wedge 1514 is attached to magnet rotor ring 1503. When rotating, load wedge 1514 applies a compression force to the levered section of forward load cell 1515 or reverse load cell 1516 depending on the tangent force 1511 experienced. As described previously, load cell ring 1513 is captured by typical front and back rotor cover 1502. Load cell ring 1513 may also include a cable or strap collection channel 1523 feature for cable or strap management during extension and retraction of forces. Further accuracy of force measurement can be incorporated by adding a second load cell configuration forming a full Wheatstone bridge in alternate mount 1521 section of magnet rotor ring 1503.

Figure 16:
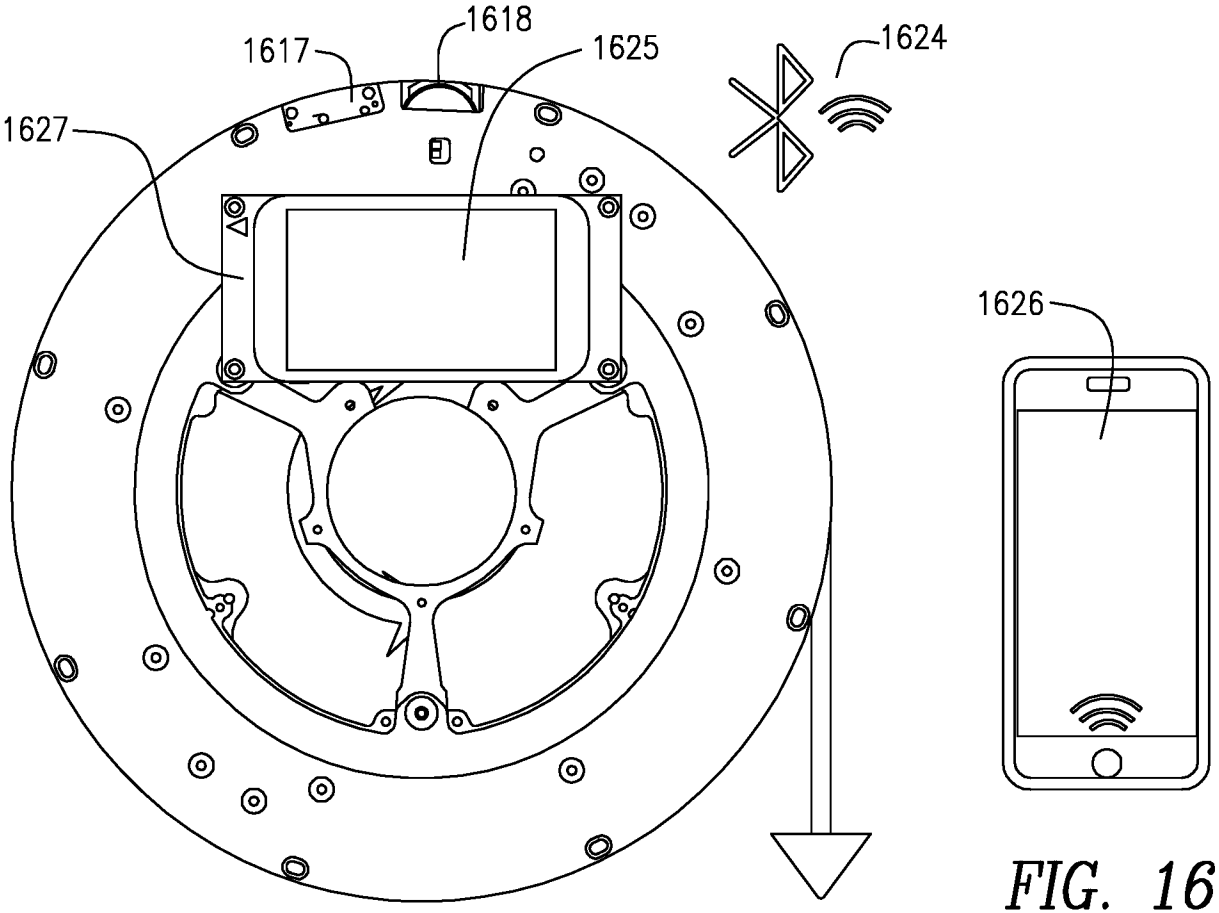
FIG. 16 shows a front view of a DMRM and force sensor module and a user device.

FIG. 16 illustrates components of the force sensor module, including load cell amp 1617 and embedded wireless device 1618 with wireless communication 1624 method, local display 1625, user device 1626 and processing element 1627, for example, for further analysis, filtering and tracking on a computer, microprocessor, or other devices, as system node options.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

The invention claimed is:

1. A method for measuring bi-directional torsional forces for adjusting standard and dynamic torque-to-linear forces on an electromechanical torsional force generating device in real-time, the method comprising:

attaching force transducing load cells arranged in Wheatstone bridge wired configuration, wherein the load cells convert a compression force vector into a rotational torque vector;

transferring a rotational force of a rotor to the load cells using a load wedge;

wirelessly communicating information to and/or from the rotor to a stator section of the electromechanical device via an embedded wireless device;

determining activity data measurements using the force transducing load cell arrangement;

transmitting the activity data measurements and wirelessly communicated information to a processing unit for analysis according to predetermined sets of evaluation rules;

applying one set of evaluation rules to determine at least one apparatus condition parameter using at least one tracking parameter;

transmitting at least one apparatus condition parameter to a motor controller of the electromechanical torsional force generating device or a user device;

providing real-time control of at least one apparatus condition parameter using the user device; and adjusting, in real-time, the torque-to-linear forces experienced by the user or load by the electromechanical torsional force generating device.

2. The method as recited in claim 1, wherein the determined activity data measurements can be processed and utilized for closed loop feedback motor control in real-time.

3. The method as recited in claim 2, wherein the feedback can be used to vary forces experienced by a user or motor load dynamically.

4. The method as recited in claim 1, wherein the electromechanical torsional force generating device is a motor, flywheel apparatus or a resistive load connected to a rotor of a device.

5. The method as recited in claim 1, wherein determining activity data measurements includes measuring torsional forces or rotational position.

6. The method as recited in claim 1, wherein the load cells are arranged to allow torsional forces to be measured.

7. The method as recited in claim 1, wherein load cells are calibrated and correlated to a unit force scale.

8. The method as recited in claim 7, wherein the torsional forces are measured in both forward and reverse rotational conditions.

9. The method as recited in claim 1, wherein the load cells are arranged in a half Wheatstone bridge wired configuration.

10. The method as recited in claim 1, wherein the load cells are arranged in a full Wheatstone bridge wired configuration.

11. The method as recited in claim 1, wherein sensor forces are communicated from the rotor to the stator section of the electromechanical torsional force generating device using a slip connector.

12. The method as recited in claim 1, wherein the communicated information includes sensor force and positional data.

* * * * *